US010831227B2

(12) United States Patent
Feng et al.

(10) Patent No.: US 10,831,227 B2
(45) Date of Patent: Nov. 10, 2020

(54) REFERENCE VOLTAGE CIRCUIT WITH LOW TEMPERATURE DRIFT

(71) Applicant: Gree Electric Appliances, Inc. of Zhuhai, Guangdong (CN)

(72) Inventors: Yuming Feng, Guangdong (CN); Liang Zhang, Guangdong (CN); Xinchao Peng, Guangdong (CN); Yijun Xu, Guangdong (CN); Jianxun Li, Guangdong (CN); Yuhua Xie, Guangdong (CN); Shirong Fan, Guangdong (CN); Jia Zhou, Guangdong (CN); Wenjie Yang, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 16/486,800

(22) PCT Filed: Oct. 19, 2017

(86) PCT No.: PCT/CN2017/106875
§ 371 (c)(1),
(2) Date: Aug. 16, 2019

(87) PCT Pub. No.: WO2018/149166
PCT Pub. Date: Aug. 23, 2018

(65) Prior Publication Data

US 2019/0361476 A1 Nov. 28, 2019

(30) Foreign Application Priority Data

Feb. 16, 2017 (CN) ..... 2017 1 0083188

(51) Int. Cl.
*G05F 1/10* (2006.01)
*G03F 3/02* (2006.01)
*G05F 3/26* (2006.01)

(52) U.S. Cl.
CPC ..... *G05F 3/262* (2013.01)

(58) Field of Classification Search
CPC ..... G05F 3/262; G05F 3/242; G05F 3/205; G05F 3/247; G05F 3/245
(Continued)

(56) References Cited

U.S. PATENT DOCUMENTS 6,441,680 B1 8/2002 Leung et al.
2008/0007243 A1* 1/2008 Matsumoto ..... G05F 3/30 323/313
(Continued)

FOREIGN PATENT DOCUMENTS

CN 102253684 11/2011
CN 102279611 12/2011
(Continued)

OTHER PUBLICATIONS

Zhang, Quian; "(Design of Voltage Reference Base on CMOS Threshold Voltage)"; CMOS; 2009; p. 184-188.
(Continued)

*Primary Examiner* — Anh Q Tra
(74) *Attorney, Agent, or Firm* — Brandon V. Zuniga; James R. Gourley; Carstens & Cahoon, LLP

(57) ABSTRACT

Disclosed is a reference voltage circuit with low temperature drift, including a first voltage unit, a second voltage unit and a K times' amplification unit. The first voltage unit is configured to generate a first voltage, with a first end thereof being grounded. The K times' amplification unit is configured to amplify the first voltage by K times, with a first end thereof being connected to a second end of the first voltage
(Continued)

unit, and with a second end thereof being connected to a first end of the second voltage unit, wherein K is a constant greater than zero. The second voltage unit is configured to generate a second voltage, with the first end thereof being connected to a current source circuit, and a second end thereof being connected to a third end of the first voltage unit to serve as an output end of a reference voltage ($V_{REF}$).

9 Claims, 6 Drawing Sheets

(58) Field of Classification Search
USPC ..... 327/539, 512–513, 543; 323/313, 315
See application file for complete search history.

(56) References Cited

U.S. PATENT DOCUMENTS

2008/0169794 A1 7/2008 Rentala et al.
2009/0146727 A1* 6/2009 Huang ..... G05F 3/30 327/513
2009/0160539 A1* 6/2009 Hsieh ..... G05F 3/262 327/543
2010/0007322 A1* 1/2010 Huang ..... G05F 3/242 323/312
2010/0237932 A1 9/2010 Yano
2012/0119819 A1 5/2012 Pyo et al.
2013/0193935 A1* 8/2013 Pan ..... G05F 1/10 323/268

FOREIGN PATENT DOCUMENTS

CN 101598954 B 1/2012
CN 104793689 7/2015
CN 104977970 A 10/2015
CN 204808102 U 11/2015
CN 105892548 8/2016
CN 106774594 5/2017
CN 206479868 9/2017
JP 2015087802 5/2015

OTHER PUBLICATIONS

E/D NMOS Voltage Reference; ACTA Electronica Sinica; vol. 15; Mar. 1987.
Extended European Search Report for EP Application No. 17896753.5 dated Jul. 22, 2020 (12 pages).

* cited by examiner

REFERENCE VOLTAGE CIRCUIT WITH LOW TEMPERATURE DRIFT

CROSS REFERENCE TO RELATED APPLICATIONS

This application is a US 371 Application from PCT/CN2017/106875 filed Oct. 19, 2017, which claims priority to Chinese Application No. 201710083188.4 filed Feb. 16, 2017, the technical disclosures of which are hereby incorporated herein by reference.

TECHNICAL FIELD

The present disclosure relates to a technical field of semiconductor integrated circuit, and more particularly to a reference voltage circuit with low temperature drift.

BACKGROUND

With the development of technology and the improvement of living standard, the portable device has become one of the necessities in life. The hybrid integrated circuit design, as the brain of the portable device, is faced with more complex and varied requirements and challenges while widely used. The cornerstone of the hybrid integrated circuit, i.e., the performance of the reference voltage, directly affects the performance experience of the terminal portable device. The temperature characteristic of the reference voltage directly determines the temperature range of operating the terminal device, and the minimum operating voltage of the reference voltage circuit limits another important performance, i.e., the endurance capacity of the terminal equipment.

The conventional design of the bandgap reference voltage is to generate the voltage with a positive temperature coefficient and the voltage with a negative temperature coefficient respectively, and then obtain the reference voltage with a zero temperature coefficient through calculation. It is relatively convenient to generate the voltage with the negative temperature coefficient, while it is not easy to obtain the reference voltage with the positive temperature coefficient. In conventional implementation modes, the reference voltage with the positive temperature coefficient is acquired by a voltage difference between base-emitter voltages of two transistors operating at different current densities. However, the designed circuit including the operational amplifier is difficult to operate normally under the condition of a low voltage, such as a voltage below 2V. In order to reduce the matching error, a larger number of transistors with larger sizes are usually selected, and the integrated circuit made in this way has a larger layout and a higher cost.

In the conventional technology, depletion-mode field-effect transistors are used to ensure the circuit to operate normally under an extremely low voltage. However, the temperature coefficient of the output reference voltage cannot be guaranteed, therefore the output reference voltage fluctuates greatly with the temperature, and the temperature has a great impact on the output of the reference voltage, thus it is very difficult to satisfy the application requirements for high precision.

SUMMARY

In view of this, to address the problem in the prior art that the temperature has a great impact on the output reference voltage when the depletion-mode field-effect transistors are used to ensure the circuit to operate normally under an extremely low voltage, it is necessary to provide a reference voltage circuit with low temperature drift, which can normally operate at an extremely low voltage, while making the relevance between the output reference voltage and the temperature extremely low.

To achieve the objectives of the present application, a reference voltage circuit with low temperature drift is provided. The reference voltage circuit includes a first voltage unit, a second voltage unit and a K times' amplification unit; wherein, the first voltage unit is configured to generate a first voltage, and a first end of the first voltage unit is grounded;

the K times' amplification unit is configured to amplify the first voltage by K times; a first end of the K times' amplification unit is connected to a second end of the first voltage unit; and a second end of the K times' amplification unit is connected to a first end of the second voltage unit, wherein K is a constant greater than zero;

the second voltage unit is configured to generate a second voltage; the first end of the second voltage unit is connected to a current source circuit; and a second end of the second voltage unit is connected to a third end of the first voltage unit, and serves as an output end of a reference voltage.

In an embodiment, the first voltage unit includes an NMOSFET (N-channel Metal-Oxide Semiconductor Field-Effect Transistor) MN; the second voltage unit includes a PMOSFET (P-channel Metal-Oxide Semiconductor Field-Effect Transistor) MP; the K times' amplification unit includes a resistor R1 and a resistor R2; wherein, a source of the NMOSFET MN is connected to a first end of the resistor R2 and then grounded; a gate of the NMOSFET MN is connected to a second end of the resistor R2 and then connected to a first end of the resistor R1; a drain of the NMOSFET MN is connected to a drain and a gate of the PMOSFET MP and serves as the output end of the reference voltage; and a source of the PMOSFET MP is connected to a second end of the resistor R1 and connected to the current source circuit.

In an embodiment, the first voltage unit includes an NPN transistor QN; the second voltage unit includes a PNP transistor QP; the K times' amplification unit includes a resistor R1 and a resistor R2; wherein, an emitter of the NPN transistor QN is connected to a first end of the resistor R2 and then grounded; a base of the NPN transistor QN is connected to a second end of the resistor R2 and then connected to a first end of the resistor R1; a collector of the NPN transistor QN is connected to a collector and a base of the PNP transistor QP, and serves as the output end of the reference voltage; and an emitter of the PNP transistor QP is connected to a second end of the resistor R1, and then connected to the current source circuit.

In an embodiment, the current source circuit includes a current mirror circuit.

In an embodiment, the current mirror circuit includes a PMOSFET MP1, a PMOSFET MP2, a PMOSFET MP3, an NMOSFET MN1, an NMOSFET MN2 and a resistor Rs, wherein:

a source of the PMOSFET MP1, a source of the PMOSFET MP2 and a source of the PMOSFET MP3 are connected to the power supply; a gate of the PMOSFET MP2 and a gate of the PMOSFET MP3 are connected to a gate of the PMOSFET MP1; and the gate of the PMOSFET MP3 is connected to a drain of the PMOSFET MP2;

a drain of the PMOSFET MP1 is connected to a drain and a gate of the NMOSFET MN1; a source of the NMOSFET MN1 is grounded;

the drain of the PMOSFET MP2 is connected to a drain of the NMOSFET MN2; a gate of the NMOSFET MN2 is connected to a gate of the NMOSFET MN1; and a source of the NMOSFET MN2 is connected to the resistor Rs and then grounded;

a drain of the PMOSFET MP3 is connected to the first end of the second voltage unit.

The present application further provides a reference voltage circuit with low temperature drift, including a first voltage unit, a second voltage unit and a K times' amplification unit; wherein, the first voltage unit is configured to generate a first voltage; a first end of the first voltage unit is grounded;

the K times' amplification unit is configured to amplify the first voltage by K times; a first end of the K times' amplification unit is connected to a second end of the first voltage unit; a second end of the K times' amplification unit is connected to a third end of the first voltage unit and connected to a current source circuit; wherein K is a constant greater than zero;

the second voltage unit is configured to generate a second voltage; a first end of the second voltage unit is connected to the third end of the first voltage unit and connected to the current source circuit; and a second end of the second voltage unit serves as an output end of a reference voltage.

In an embodiment, the first voltage unit includes a PMOSFET MP and a MOSFET M1; the second voltage unit includes an NMOSFET MN and a MOSFET M2; the K times' amplification unit includes a resistor R1 and a resistor R2; wherein:

a gate of the PMOSFET MP is connected to a first end of the resistor R1 and a first end of the resistor R2; a source the PMOSFET MP is connected to a second end of the resistor R1 and then connected to the current source circuit; a drain of the PMOSFET MP is connected to a gate and a drain of the MOSFET M1; a source of the MOSFET M1 is grounded; a second end of the R2 is grounded;

a gate and a drain of the NMOSFET MN are connected to the current source circuit; a source of the NMOSFET MN serves as the output end of the reference voltage and is connected to a drain of the MOSFET M2; a gate of the MOSFET M2 is connected to a gate and a drain of the MOSFET M1; and a source of the MOSFET M2 is grounded.

In an embodiment, the first voltage unit includes a PNP transistor QP and a transistor Q1; the second voltage unit includes an NPN transistor QN and a transistor Q2; the K times' amplification unit includes a resistor R1 and a resistor R2, wherein:

a base of the PNP transistor QP is connected to a first end of the resistor R1 and a first end of the resistor R2; an emitter of the PNP transistor QP is connected to a second end of the resistor R1 and connected to the current source circuit; a collector of the PNP transistor QP is connected to a base and a collector of the transistor Q1, an emitter of the transistor Q1 is grounded; a second end of the resistor R2 is grounded;

a base and a collector of the NPN transistor QN are connected to the current source circuit; an emitter of the NPN transistor QN serves as the output end of the reference voltage and is connected to a collector of the transistor Q2; a base of the transistor Q2 is connected to the base and the collector of the transistor Q1; and an emitter of the transistor Q2 is grounded.

In an embodiment, the current source circuit includes a current mirror circuit.

In an embodiment, the current mirror circuit includes a PMOSFET MP1, a PMOSFET MP2, a PMOSFET MP3, an NMOSFET MN1, an NMOSFET MN2, and a resistor Rs, wherein:

a source of the PMOSFET MP1, a source of the PMOSFET MP2 and a source of the PMOSFET MP3 are connected to the same power supply; a gate of the PMOSFET MP2 and a gate of the PMOSFET MP3 are connected to a gate of the PMOSFET MP1; and a gate of the PMOSFET MP3 is connected to a drain of the PMOSFET MP2;

a drain of the PMOSFET MP1 is connected to a drain and a gate of the NMOSFET MN1; and a source of the NMOSFET MN1 is grounded;

the drain of the PMOSFET MP2 is connected to a drain of the NMOSFET MN2; a gate of the NMOSFET MN2 is connected to a gate of the NMOSFET MN1; and a source of the NMOSFET MN2 is connected to the resistor Rs and grounded; and a drain of the PMOSFET MP3 is connected to the first end of the second voltage unit.

The advantages of the disclosure are as follows:

As for the above-mentioned reference voltage circuit with low temperature drift, the first voltage unit and second voltage unit both having the same positive temperature coefficient or the same negative temperature coefficient are directly utilized, to calculate and obtain the value of K satisfying $K*(\partial V_1/\partial T)=(\partial V_2/\partial T)$, and then design a K times' amplification unit based on the value of K obtained through calculation; and the K times' amplification unit is connected into the circuit, thereby making the output reference voltage have extremely low correlation with the temperature, or even independent of the temperature, i.e., achieving the effects that, under different temperatures, the output reference voltages do not diverge greatly which can satisfy the application requirements for high precision. What's more, the circuit has simple structure, and few device types are required, thereby greatly reducing the difficulty and the risks in design. The reference voltage circuit has very high practicability and versatility in the field of integrated circuit.

DETAILED DESCRIPTION OF DISCLOSED EMBODIMENTS

In order to make the objectives, technical solutions and advantages of the present disclosure clearer, the reference voltage circuit with low temperature drift of the present disclosure will be further described in detail below through embodiments with reference to accompanying drawings. It should be understood that the specific embodiments described herein are merely illustration of the disclosure, but not intended to limit the present disclosure.

Figure 1:
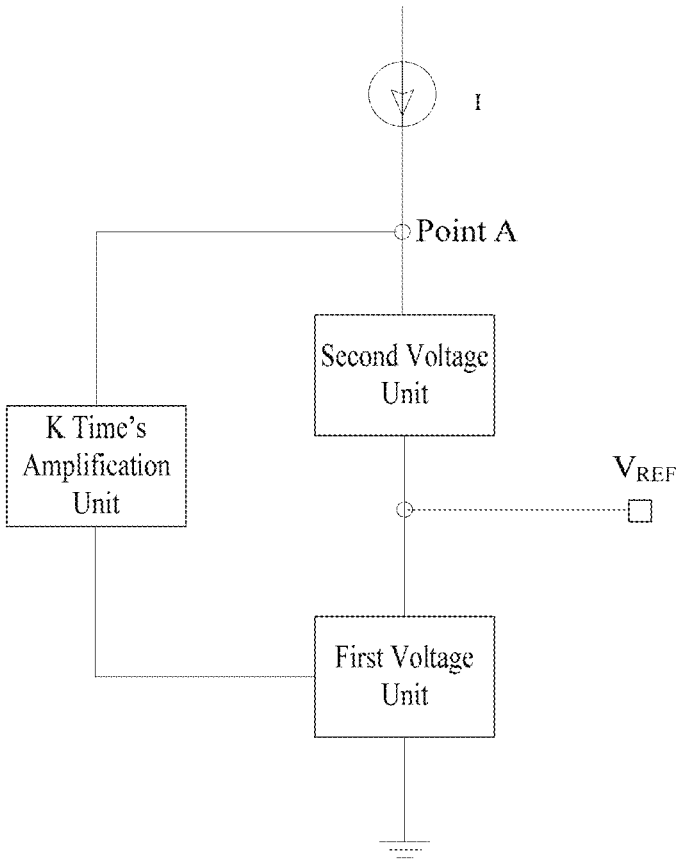
FIG. 1 is a schematic circuit diagram of an embodiment of a reference voltage circuit with low temperature drift.

In an embodiment, as shown in FIG. 1, a reference voltage circuit with low temperature drift is provided. The reference voltage circuit includes a first voltage unit, a second voltage unit and a K times' amplification unit. The first voltage unit is configured to generate a first voltage, and a first end of the first voltage unit is grounded. The K times' amplification unit is configured to amplify the first voltage by K times. A first end of the K times' amplification unit is connected to a second end of the first voltage unit, and a second end of the K times' amplification unit is connected to a first end of the second voltage unit, wherein K is a constant greater than zero. The second voltage unit is configured to generate a second voltage; the first end of the second voltage unit is connected to a current source circuit; and a second end of the second voltage unit is connected to a third end of the first voltage unit to serve as an output end of the reference voltage.

In the embodiment of the reference voltage circuit with low temperature drift, the first voltage unit generates a first voltage $V_1$ when operating, and the second voltage unit generates a second voltage $V_2$ when operating. The voltage $V_A$ at point A in the circuit is determined by the K times' amplification unit and the first voltage unit together, i.e., $V_A=K*V_1$; and the output reference voltage $V_{REF}$ satisfies $V_{REF}=K*V_1-V_2$. In order to make the output reference voltage $V_{REF}$ independent of the temperature, it is required that $\partial V_{REF}/\partial T=K*(\partial V_1/\partial T)-(\partial V_2/\partial T)=0$, i.e., $K*(\partial V_1/\partial T)=(\partial V_2/\partial T)$. However, with regard to the commonly used first and second voltage units, such as a Metal-Oxide Semiconductor Field-Effect Transistor (MOSFET) and a transistor, the temperature coefficients of the voltages decrease as the temperature increases, that is, the commonly used first voltage unit and the second voltage unit have temperature coefficients in the same direction, i.e., $(\partial V_1/\partial T)*(\partial V_2/\partial T)>0$. In order to ensure that $K*(\partial V_1/\partial T)=(\partial V_2/\partial T)$, the value of K needs to be a constant greater than zero (if the value of K is negative, it cannot satisfy the equation), that is, the value of K satisfying the equation $K*(\partial V_1/\partial T)=(\partial V_2/\partial T)$ is calculated and obtained by $(\partial V_1/\partial T)$ and $(\partial V_2/\partial T)$, and then the K times' amplification unit is designed according to the value of K, thereby making the output reference voltage $V_{REF}$ independent of the temperature.

As for the reference voltage circuit with low temperature drift in the present embodiment, the first voltage unit and the second voltage unit both having positive temperature coefficients or negative temperature coefficients are directly used to calculate and obtain the value of K satisfying $K*(\partial V_1/\partial T)=(\partial V_2/\partial T)$, and then design a K times' amplification unit based on the value of K obtained through calculation. The K times' amplification unit is connected between the second end of the first voltage unit and the first end of the second voltage unit, thereby making the output reference voltage have extremely low correlation with the temperature, or even independent of the temperature, that is, achieving the effects that, under different temperatures, the output reference voltages do not diverge greatly, which can satisfy the application requirements for high precision. What's more, the circuit has simple structure, and few device types are required, thereby greatly reducing the difficulty and the risks in design. The reference voltage circuit has very high practicability and versatility in the field of the integrated circuit.

Wherein, the first voltage unit and the second voltage unit can be MOSFETs or transistors respectively.

Figure 2:
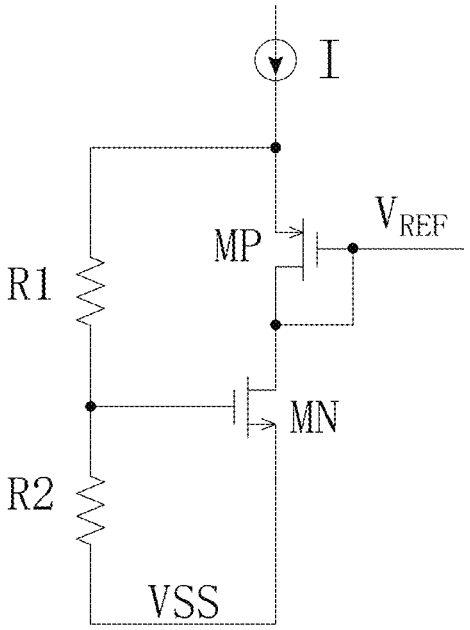
FIG. 2 is a schematic circuit diagram of a specific embodiment of the reference voltage circuit with low temperature drift shown in FIG. 1.

In an embodiment, referring to FIG. 2, the first voltage unit includes an N-channel Metal-Oxide Semiconductor Field-Effect Transistor (NMOSFET) MN; the second voltage unit includes a P-channel Metal-Oxide Semiconductor Field-Effect Transistor (PMOSFET) MP; and the K times' amplification unit includes a resistor R1 and a resistor R2. Wherein, the source of the MOSFET MN is connected to a first end of the resistor R2 and then grounded, and the gate of the NMOSFET MN is connected to a second end of the resistor R2 and then connected to the first end of the resistor R1, and the drain of the NMOSFET MN is connected to the drain and the gate of the PMOSFET MP to serve as an output end of the reference voltage. The source of the PMOSFET MP is connected to the second end of the resistor R1 and then connected to a current source circuit.

The present embodiment is a specific circuit structure for implementing the circuit diagram shown in FIG. 1, which is a preferred embodiment. The circuit mainly includes a PMOSFET MP (corresponding to the second voltage unit), an NMOSFET MN (corresponding to the first voltage unit) and resistors R1 and R2 (corresponding to the K times' amplification unit). When the power is turned on, the current source circuit generates a current I, the current I first flows through the resistors R1 and R2. The NMOS transistor MN is turned on, when the current I, the resistor R2 and the turn-on threshold Vthn of the NMOSFET MN satisfy $I*R2=Vgsn>Vthn$, where Vgsn is the voltage of the gate of the NMOSFET MN, and at this time the gate voltage of the NMOSFET MN is pulled low. When the gate-source voltage of the PMOSFET MP satisfies $|Vgsp|>|Vthp|$, the PMOSFET is turned on, and at this time, the PMOSFET MP divides the current I, thereby reducing the currents flowing through the resistors R1 and R2. When the current flowing through the resistors R1 and R2 is too small, it can be known from $I*R2=Vgsn>Vthn$ that the gate voltage Vgsn of the NMOSFET MN will be reduced, and the shunt current of the current I, which flows through the PMOSFET MP, is also reduced, thereby increasing the currents flowing through the resistors R1 and R2. At last, the whole circuit tends to be stable after repetition of such process. When the circuit is finally stabilized, the reference voltage $V_{REF}$ is determined by the following equation:

$V_{REF}=(1+R1/R2)\ Vgsn-|Vgsp|$, where Vgsp is the gate-source voltage of the PMOSFET MP.

For the NMOSFET MN and the PMOSFET MP, there are: $Vgsn=Vdsatn+Vthn$, and $|Vgsp|=|Vdsatp|+|Vthp|$, where Vdsatn is the voltage variation value of the NMOSFET, and Vdsatp is the voltage variation value of the PMOSFET. From the above equations: $V_{REF}=(1+R1/R2)Vgsn-|Vgsp|$, $Vgsn=Vdsatn+Vthn$, and $|Vgsp|=|Vdsatp|+|Vthp|$, we get that, when the current I is constant, and if the resistances of the resistors R1 and R2 are sufficiently large, the reference voltage $V_{REF}$ is independent of the supply voltage. When the current I is constant, and if the width-to-length ratio of the NMOSFET MN and the width-to-length ratio of the PMOSFET MP are sufficiently large, the voltage variation values Vdsatn and Vdsatp have little impact on the NMOSFET MN and the PMOSFET MP (similar to a water pipe, when the width-to-length ratio of the water pipe is sufficiently large, the variation value of the water flow rate has little impact on the water pipe). Vgsn and |Vgsp| have little correlation with the current I and are mainly determined by Vthn and |Vthp|, while Vthn and |Vthp| are determined by the processes for producing the NMOSFET MN and the PMOSFET MP. For most processes, the temperature coefficient Tgsn of Vgsn and temperature coefficient Tgsp of |Vgsp| are both negative and satisfy |Tgsn|<|Tgsp|. Therefore, when the ratio of R1 to R2 is set properly, and satisfies (1+R1/R2)|Tgsn|=|Tgsp|, the reference voltage $V_{REF}$ is independent of the temperature.

As for the reference voltage circuit with low temperature drift in the present embodiment, two voltages both having negative temperature coefficients are utilized to compute and obtain a voltage having a zero temperature coefficient. In order to generate the reference voltage, the supply voltage only needs to be higher than (1+R1/R2)Vgsn≈Vthn+Vthp, and the circuit of the present embodiment is implemented by providing only four devices including the PMOSFET MP, the NMOSFET MN, and the resistors R1 and R2. The structure of the reference voltage circuit is extremely simple and is easy to implement; the layout of the integrated circuit is small in size; and the reference voltage circuit is of great value in the industrial application.

Figure 3:
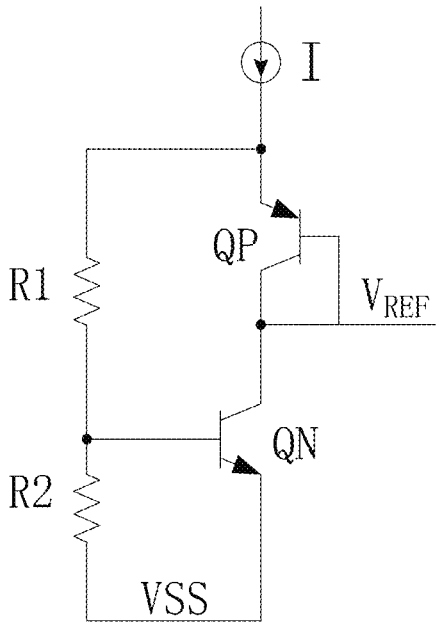
FIG. 3 is a schematic circuit diagram of another specific embodiment of the reference voltage circuit with low temperature drift shown in FIG. 1.

In an embodiment, referring to FIG. 3, the first voltage unit includes an NPN transistor QN; the second voltage unit includes a PNP transistor QP; and the K times' amplification unit includes a resistor R1 and a resistor R2. Wherein, the emitter of the NPN transistor QN is connected to the first end of the resistor R2 and then grounded; the base of the NPN transistor QN is connected to the second end of the resistor R2 and then connected to the first end of the resistor R1; and the collector of the NPN transistor QN is connected to the collector and base of the PNP transistor QP to serve as the output end of the reference voltage. The emitter of the PNP transistor QP is connected to the second end of the resistor R1 and then connected to the current source circuit.

The present embodiment is a specific circuit structure for implementing the circuit diagram shown in FIG. 1, and instead of the MOSFET in the foregoing embodiment, a transistor is provided in this embodiment, to save the cost of the devices in the circuit devices. Since the principle of this embodiment is similar to that of the foregoing embodiment, this embodiment will not be described repeatedly here.

Figure 4:
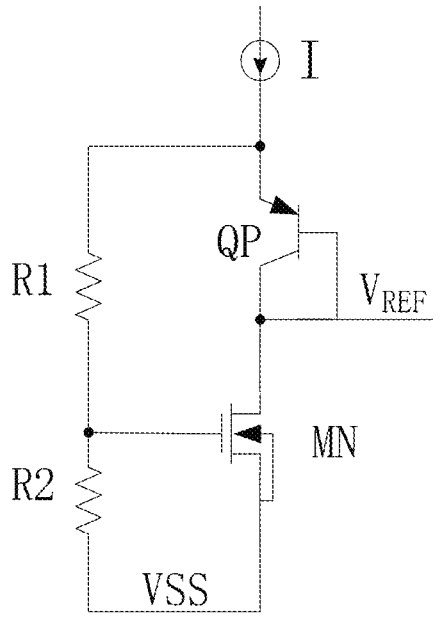
FIG. 4 is a schematic circuit diagram of yet another specific embodiment of the reference voltage circuit with low temperature drift shown in FIG. 1.

In an embodiment, referring to FIG. 4, the reference voltage circuit with low temperature drift may be a hybrid circuit of a transistor and a MOSFET, to achieve the effect that the reference voltage is independent of the temperature.

Figure 5:
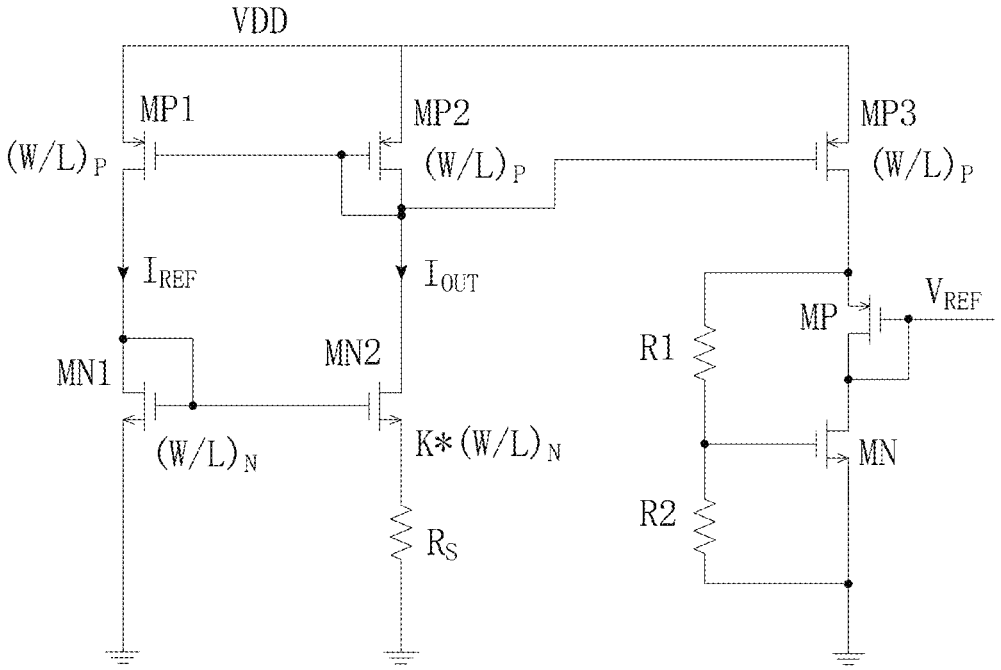
FIG. 5 is a schematic circuit diagram of an embodiment of the reference circuit with low temperature drift including a current source circuit.

In an embodiment, referring to FIG. 5, the current source circuit includes a current mirror circuit. Specifically, the current mirror circuit includes a PMOSFET MP1, a PMOSFET MP2, a PMOSFET MP3, an NMOSFET MN1, an NMOSFET MN2, and a resistor Rs. Wherein, the sources of the PMOSFET MP1, the PMOSFET MP2 and the PMOSFET MP3 are connected to the same power supply; the gates of the PMOSFET MP2 and the PMOSFET MP3 are connected to the gate of the PMOSFET MP1, and the gate of the PMOSFET MP3 is connected to the drain of the PMOSFET MP2. The drain of the PMOSFET MP1 is connected to the drain and the gate of the NMOSFET MN1, and the source of the NMOSFET MN1 is grounded. The drain of the PMOSFET MP2 is connected to the drain of the NMOSFET MN2, the gate of the NMOSFET MN2 is connected to the gate of the NMOSFET MN1, and the source of the NMOSFET MN2 is connected to the resistor Rs and then grounded. The drain of the PMOSFET MP3 is connected to the first end of the second voltage unit.

As for the specific circuit structure for generating the current I in the above embodiment, the current mirror circuit can generate the stable current I independent of the power supply. The current mirror circuit mainly includes a PMOSFET MP1 and a PMOSFET MP2, an NMOSFET MN1 and an NMOSFET MN2, and a resistor Rs. Wherein, the PMOSFET MP1 and the PMOS transistor MP2 have the same geometry sizes, and the proportion of the geometry sizes of the NMOSFET MN1 to the NMOSFET MN2 is 1: k.

From the NMOSFETs MN1, MN2 and the resistor Rs, it follows that: Vgs1=Vgs2+I*Rs, where I is the current flowing through the NMOSFETs MN1 and MN2, and Vgs1 and Vgs2 are respectively the gate voltages of the NMOSFET MN1 and the NMOSFET MN2. According to the above formula and the equation of the drain current and the gate voltage of the NMOSFET operating in the saturation region, it is obtained that $I=2/(un\ Cox\ (W/L)N)*1/(Rs^2)*(1-1/\sqrt{k})^2$, where W/L is the width-to-length ratio of the NMOSFET, $u_n$ is the migration rate of electrons of the NMOSFET, and $C_{ox}$ is the capacitance per unit area of gate oxide layer of the NMOSFET. From this formula, it is not difficult to find that the current I is independent of the supply voltage (but is still a function of the temperature and the process), the magnitude of the current I is determined by the resistance of the resistor Rs and the proportion coefficient k of the geometry sizes of the NMOSFET MN2 to the NMOSFET MN1.

The PMOSFETs MP and MP3, the NMOSFET MN, and the resistors R1 and R2 shown in the circuit of FIG. 5 are mainly configured to generate the reference voltage $V_{REF}$. The PMOSFET MP3 and the PMOSFETs MP1, MP2 have the same geometry sizes and together form the current mirror circuit. The magnitude of the current output by the PMOSFET MP3 is equal to the magnitude of the current I of the PMOSFETs MP1 and MP2.

Figure 6:
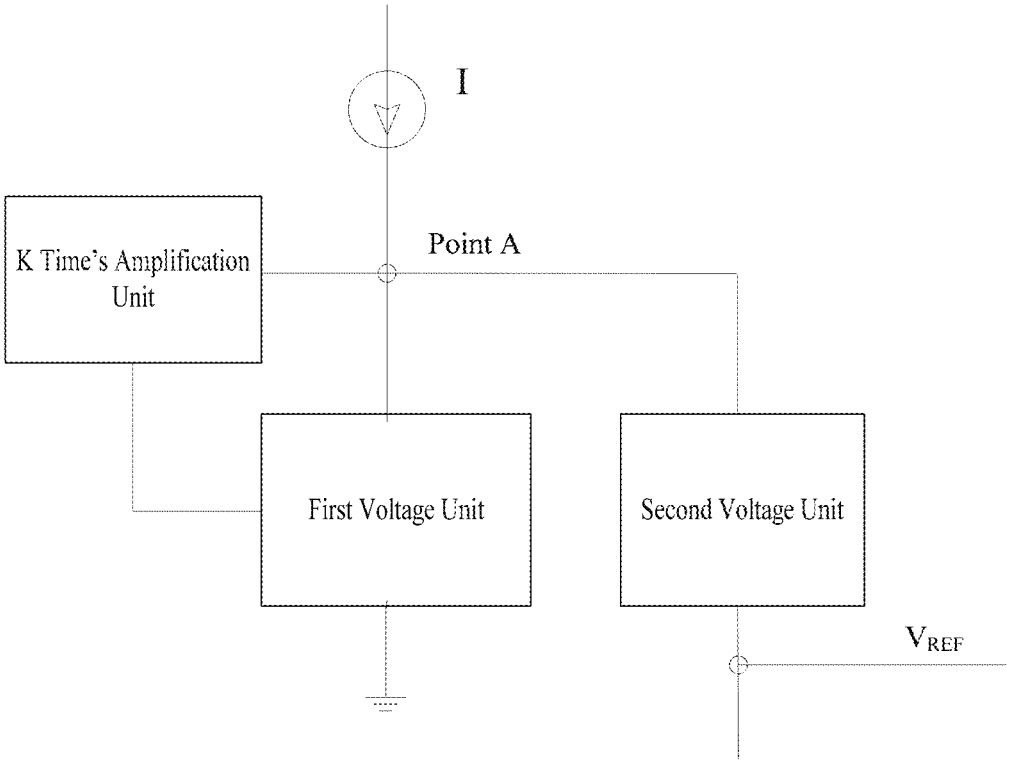
FIG. 6 is schematic circuit diagram of another embodiment of the reference circuit with low temperature drift.

Based on the same invention concept, a reference voltage circuit with low temperature drift is further provided. As shown in FIG. 6, the circuit includes a first voltage unit, a second voltage unit, and a K times' amplification unit. The first voltage unit is configured to generate a first voltage, and the first end of the first voltage unit is grounded. The K times' amplification unit is configured to amplify the first voltage by K times; the first end of the K times' amplification unit is connected to the second end of the first voltage unit; and the second end of the K times' amplification unit is connected to the third end of the first voltage unit and then connected to the current source circuit, wherein K is a constant greater than zero. The second voltage unit is configured to generate a second voltage, the first end of the second voltage unit is connected to the third end of the first voltage unit and then connected to the current source circuit, and the second end of the second voltage unit serves as an output end of the reference voltage.

The operating principle of the reference voltage circuit with low temperature drift in the present embodiment is similar to that of the reference voltage circuit with low temperature drift in the foregoing embodiments. The first voltage unit generates a first voltage $V_1$ when operating, and the second voltage unit generates a second voltage $V_2$ when operating. The voltage $V_A$ at point A in the circuit is determined by the K times' amplification unit and the first voltage unit together, i.e., satisfies $V_A=K*V_1$, and the output reference voltage $V_{REF}$ satisfies $V_{REF}=K*V_1-V_2$. In order to make the output reference voltage $V_{REF}$ independent of the temperature, $\partial V_{REF}/\partial T=K*(\partial V_1/\partial T)-(\partial V_2/\partial T)=0$ is required, i.e., $K*(\partial V_1/\partial T)=(\partial V_2/\partial T)$ is required. As for the commonly used first and second voltage units, such as the MOSFET and the transistor, the temperature coefficients of the voltages thereof decrease as temperature increases. That is, the commonly used first and second voltage units have the temperature coefficients in the same direction, i.e., $(\partial V_1/\partial T)*(\partial V_2/\partial T)>0$. In order to ensure that $K*(\partial V_1/\partial T)=(\partial V_2/\partial T)$, the value of K needs to be a constant greater than zero. During designing the reference voltage circuit with low temperature drift of the present embodiment, it is necessary to obtain a value of K satisfying the equation $K*(\partial V_1/\partial T)=(\partial V_2/\partial T)$ through calculation according to $(\partial V_1/\partial T)$ and $(\partial V_2/\partial T)$, and then to design a K times' magnification unit according to the value of K, so as to make the output reference voltage $V_{REF}$ independent of the temperature.

As for the reference voltage circuit with low temperature drift in the present embodiment, the first voltage unit and the second voltage unit both having positive temperature coefficients or negative temperature coefficients are directly used to calculate and obtain the value of K satisfying the equation $K*(\partial V_1/\partial T)=(\partial V_2/\partial T)$, and then design a K times' amplification unit based on the value of K obtained through calculation; and the K times' amplification unit is connected into the circuit, thereby making the output reference voltage have extremely low correlation with the temperature, or even independent of the temperature, i.e., achieving the effects that, under different temperatures, the output reference voltages do not diverge greatly, which can satisfy the application requirements for high precision What's more, the circuit has simple structure, and few device types are required, thereby greatly reducing the difficulty and the risks in design. The reference voltage circuit has very high practicability and versatility in the field of the integrated circuit.

Figure 7:
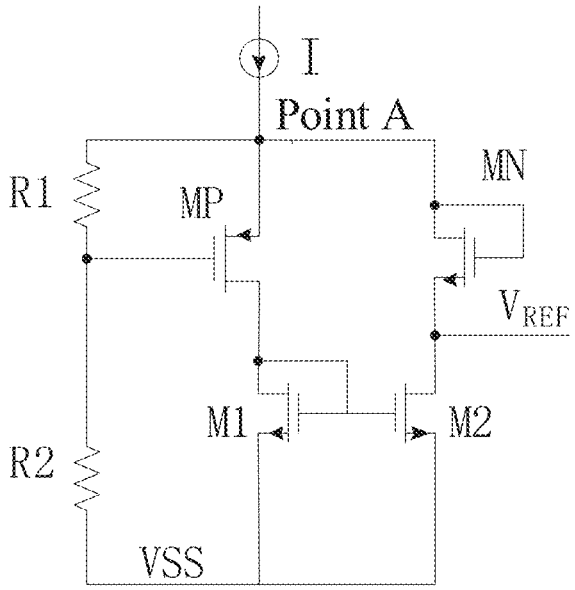
FIG. 7 is a schematic circuit diagram of a specific embodiment of the reference circuit with low temperature drift shown in FIG. 6.

In an embodiment, referring to FIG. 7, the first voltage unit includes a PMOSFET MP and a MOSFET M1; the second voltage unit includes an NMOSFET MN and a MOSFET M2; and the K times' amplification unit includes a resistor R1 and a resistor R2. Wherein: the gate of the PMOSFET MP is connected to the first end of the resistor R1 and the first end of the resistor R2; the source of the PMOSFET MP is connected to the second end of the resistor R1 and then connected to the current source circuit; the drain of the PMOSFET MP is connected to the gate and the drain of the MOSFET M1; the source of the MOSFET M1 is grounded; and the second end of the resistor R2 is grounded; the gate and the drain of the NMOSFET MN are connected to the current source circuit; the source of the NMOSFET MN serves as the output end of the reference voltage and is connected to the drain of the MOSFET M2; the gate of the MOSFET M2 is connected to the gate and the drain of the MOSFET M1; and the source of the MOSFET M2 is grounded.

The present embodiment, a preferred embodiment, is a specific circuit structure for implementing the circuit diagram shown in FIG. 6. The circuit mainly includes a PMOSFET MP and a MOSFET M1 (corresponding to a first voltage unit), an NMOSFET MN and a MOSFET M2 (corresponding to a second voltage unit), and resistors R1 and R2 (corresponding to a K times' amplification unit). When the power supply is turned on, the current source circuit generates a current I, and the current first flows through the resistors R1 and R2. When the current I flows through the resistor R1, the gate voltage of the PMOSFET MP is less than the source voltage due to the voltage drop across the resistor R1. When the gate voltage Vgsp of the PMOSFET MP satisfies Vgsp=IR1<Vthp, where Vthp is the threshold voltage of the PMOSFET MP, the PMOSFET MP is turned on. After the POMSFET MP is turned on, the gate voltages of the MOSFET M1 and the MOSFET M2 (preferably, the MOSFETs M1 and M2 are NMOSFETs) are pulled high, and at this time, the MOSFETs M1 and M2 are turned on. After the MOSFET M2 is turned on, the source voltage of the NMOSFET MN is pulled low. The gate voltage of the NMOSFET MN is the voltage at a point A. When the gate-source voltage Vgsn of the NMOSFET MN satisfies Vgsn>Vthn, the NMOSFET MN is also turned on, and at this time, the PMOSFET MP and the NMOSFET MN divide the current I, reducing the currents flowing through the resistors R1 and R2. When the current flowing through the resistors R1 and R2 is too small, the voltage drop across the resistor R1 decreases, and at this time, the gate voltage of the PMOSFET MP is close to the source voltage. Based on $Vgsp=V_A-I*R1$, it is concluded that the gate voltage of the PMOSFET MP will increase, and that the shunt currents of the current I, which flow through the PMOSFET MP and the NMOSFET MN are also reduced, thereby increasing the currents flowing through the resistors R1 and R2. At last, the whole circuit tends to be stable after repetition of such process. When the circuit is finally stabilized, the reference voltage $V_{REF}$ is determined by the following equation:

As for the NMOSFET MN and the PMOSFET MP, there are: Vgsn=Vdsatn+Vthn, and |Vgsp|=|Vdsatp|+|Vthp|, where Vdsatn is the voltage variation value of the NMOSFET, and Vdsatp is the voltage variation value of the PMOSFET. From the above equations $V_{REF}=(1+R1/R2)Vgsp-|Vgsn|$, Vgsn=Vdsatn+Vthn, and |Vgsp|=|Vdsatp|+|Vthp|, it is got that, when the current I is constant, and if the resistances of the resistors R1, R2 are sufficiently large, the reference voltage $V_{REF}$ is independent of the supply voltage. And when the current I is constant, and if the width-to-length ratio of the NMOSFET MN and the width-to-length ratio of the PMOSFET MP are sufficiently large, the voltage variation values Vdsatn and Vdsatp have little impact on the NMOSFET MN and on the PMOSFET MP. Vgsn and Vgsp have little correlation with the current I, and are mainly determined by Vthn and |Vthp|, while Vthn and |Vthp| are determined by the processes for producing the NMOSFET MN and the PMOSFET MP. For most processes, the temperature coefficient Tgsn of Vgsn and Tgsp of |Vgsp| are both negative and satisfy |Tgsn|>|Tgsp|, therefore, if the ratio of R1 to R2 is set properly and satisfies (1+R1/R2)|Tgsp|=|Tgsn|, then the reference voltage $V_{REF}$ is independent of the temperature.

As for the reference voltage circuit with low temperature drift in the present embodiment, two voltages both having the negative temperature coefficients are utilized to compute and obtain a voltage having a zero temperature coefficient. In order to generate the reference voltage, the supply voltage only needs to be higher than (1+R1/R2)Vgsp≈Vthn+Vthp, and the circuit of this embodiment is implemented by providing only the PMOSFET MP, the NMOSFET MN, the MOSFET M1, the MOSFET M2, and the resistors R1 and R2. The structure of the reference voltage is extremely simple and is easy to implement; the layout of the integrated circuit is small in size; and the reference voltage circuit is of great value in the industrial application.

In an embodiment, the first voltage unit includes a PNP transistor QP and a transistor Q1; the second voltage unit includes an NPN transistor QN and a transistor Q2; and the K times' amplification unit includes a resistor R1 and a resistor R2. The base of the PNP transistor QP is connected to the first end of the resistor R1 and the first end of the resistor R2. Wherein, the base of the PNP transistor QP is connected to the first end of the resistor R1 and the first end of the resistor R2, and then connected to the current source circuit; the collector of the PNP transistor QP is connected to the base and collector of the transistor Q1; the emitter of the transistor Q1 is grounded; the second end of the resistor R2 is grounded; the base and collector of the NPN transistor QN are connected to the current source circuit; the emitter of the NPN transistor QN serves as the output end of the reference voltage and is connected to the collector of the transistor Q2; the base of the transistor Q2 is connected to the base and collector of the transistor Q1, and the emitter of the transistor Q2 is grounded.

The present embodiment is a specific circuit structure for implementing the circuit diagram shown in FIG. 6, and instead of the MOSFET in the foregoing embodiment, a transistor is provided in this embodiment, to save the cost of the circuit devices. Since the principle of this embodiment is similar to that of the foregoing embodiment, this embodiment will not be described repeatedly here.

In an embodiment, the current source circuit includes a current mirror circuit. Specifically, the current mirror circuit includes a PMOSFET MP1, a PMOSFET MP2, a PMOSFET MP3, an NMOSFET MN1, an NMOSFET MN2, and a resistor Rs. Wherein, the sources of the PMOSFET MP1, the PMOSFET MP2 and the PMOSFET MP3 are connected to the same power supply; the gates of the PMOSFET MP2 and the PMOSFET MP3 are connected to the gate of the PMOSFET MP1; and the gate of the PMOSFET MP3 is connected to the drain of the PMOSFET MP2. The drain of the PMOSFET MP1 is connected to the drain and gate of the NMOSFET MN1; and the source of the NMOSFET MN1 is grounded. The drain of the PMOSFET MP2 is connected to the drain of the NMOSFET MN2; the gate of the NMOSFET MN2 is connected to the gate of the NMOSFET MN1; the source of the NMOSFET MN2 is connected to the resistor Rs and then grounded; and the drain of the PMOSFET MP3 is connected to the first end of the second voltage unit.

The present embodiment is a specific circuit structure for generating the stable current I independent of the power supply. The principle of generating the current I is described in detail in the foregoing embodiments and will not be described repeatedly here.

Figure 8:
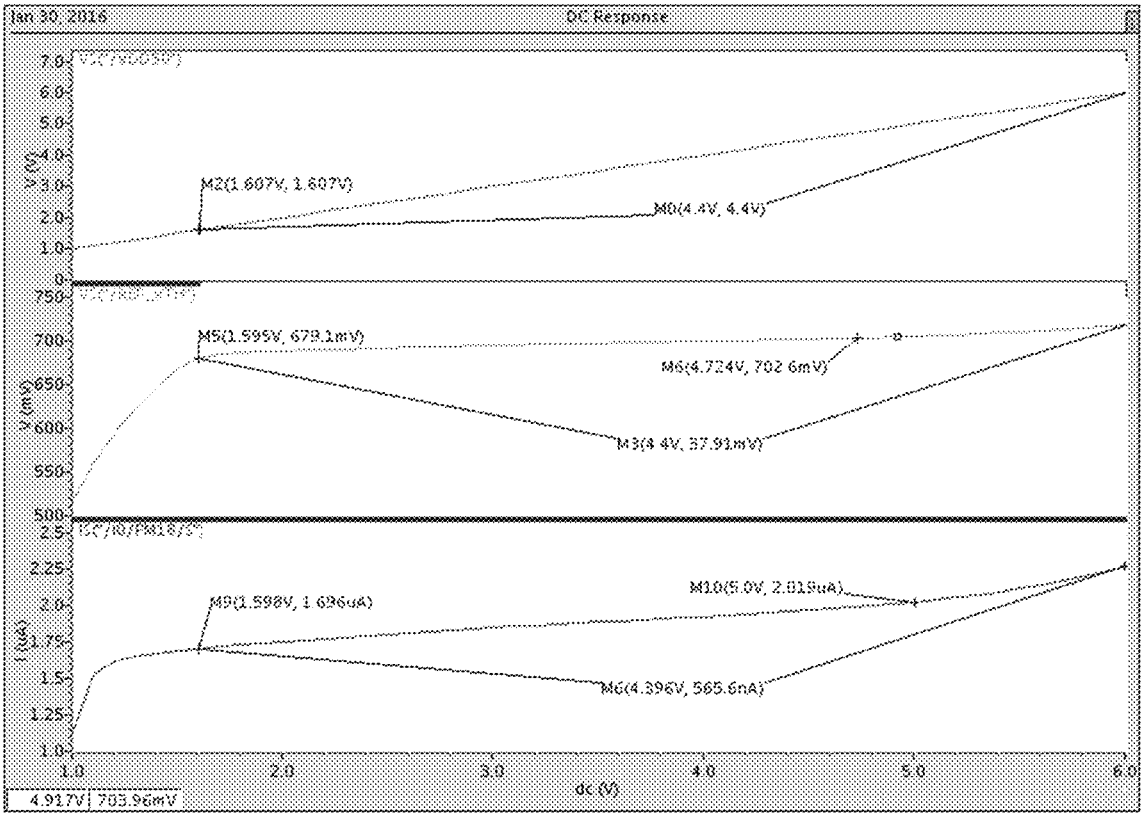
FIG. 8 is a DC voltage analysis diagram of an embodiment of the reference voltage circuit with low temperature drift.
Figure 9:
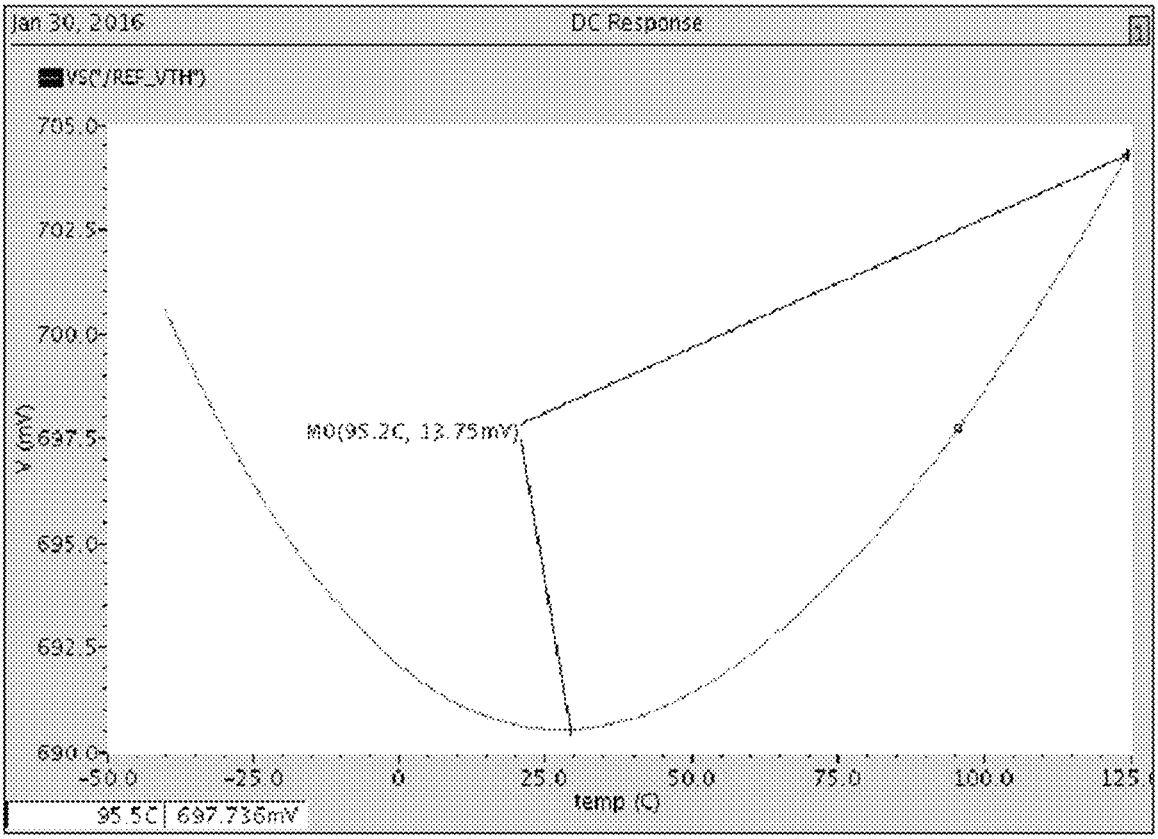
FIG. 9 is a temperature analysis diagram of an embodiment of the reference voltage circuit with low temperature drift.
Figure 10:
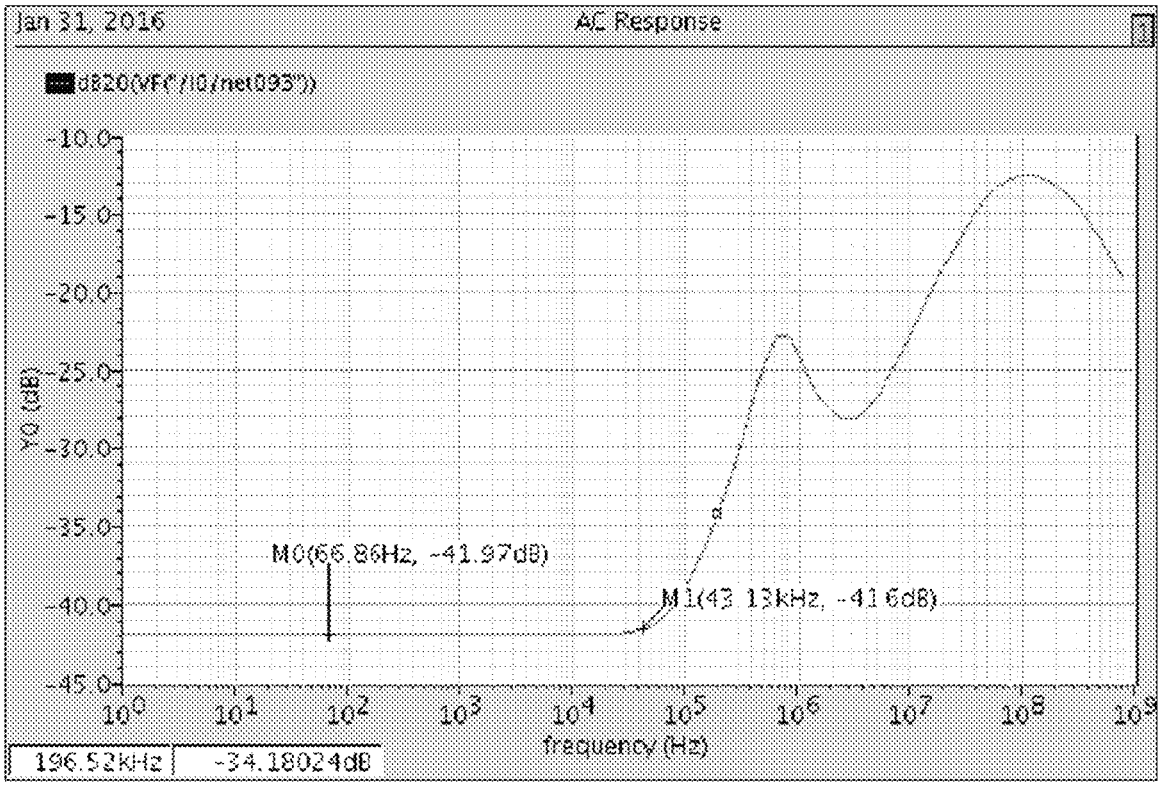
FIG. 10 is an analysis diagram of the power supply rejection ratio according to an embodiment of the reference voltage circuit with low temperature drift.

In order to further illustrate the reference voltage circuit with low temperature drift in the above embodiment, the illustration is provided in combination with the simulation results of simulating relevant parameters of the reference voltage circuit with low temperature drift as follows: FIG. 8 is a DC voltage analysis diagram of an embodiment of the reference voltage circuit with low temperature drift, and shows the variation of the reference voltage with the supply voltage varying from 1V to 6V The line in the top box of the figure simulates the variation of the supply voltage. It can be seen from the figure that the simulated variation of the supply voltage is consistent with the actual supply voltage, and the variation value of the supply voltage is 4.4V, that is, the supply voltage varies from 1.607V to 6V. The line in the middle box of the figure simulates the variation of the reference voltage with the changed supply voltage. Wherein, the point M5 indicates that a reference voltage corresponding to the supply voltage of 1.595V is 679.1 mV The line before the point M5 shows that the circuit is being established and in an unstable state. The point M6 indicates that a reference voltage corresponding to the supply voltage of 4.724V is 702.6 mV The point M3 indicates that the variation value of the reference voltage is 37.91 mV when the variation value of the supply voltage is 4.4V. The line in the lower box of the figure simulates the variation of the reference current with the changed supply voltage. The point M9 indicates that a reference current corresponding to the supply voltage of 1.598V is 1.696 μA; the point M10 indicates that the reference current corresponding to the supply voltage of 5V is 2.019 μA; and the point M6 indicates that a corresponding variation of the reference current is 565.6 nA when the variation of the supply voltage is 4.396V As can be seen from the figure, when the supply voltage is 1.595V, the reference voltage can operate normally, that is, the reference voltage can operate under an extremely low supply voltage, and the operating voltage of the reference voltage can be as low as 1.595V FIG. 9 is a temperature analysis diagram of an embodiment of the reference voltage circuit with low temperature drift, and shows variations in the relationship between a reference voltage and a temperature. Wherein, the point M0 indicates that a variation of 13.75 mV in the reference voltage corresponds to a variation of 95.2° C. in a temperature when the temperature coefficient is positive. As can be seen from the figure, when the temperature varies greatly, the reference voltage only varies a little, that is, the temperature has little impact on the data of the reference voltage, and the correlation between the output reference voltage and the temperature is extremely low. FIG. 10 is an analysis diagram of the power supply rejection ratio according to an embodiment of the reference voltage circuit with low temperature drift, and shows that when the frequency is lower than 43.13 kHz, the noise signal of the power supply can be reduced to 1% (−41.97 dB). Thereby, when the circuit of this embodiment has a certain bandwidth (43.13 kHz), the power supply has good anti-interference ability, and can output the reference voltage well; when the circuit exceeds a certain bandwidth (such as exceeding 43.13 kHz), the power supply has poor anti-interference capability. Therefore, the optimal operating environment of the circuit of the above embodiment is limited to the bandwidth below 43.13 kHz. It can be seen from the above simulations in FIG. 8 to FIG. 10 that when the temperature varies greatly, the reference voltage varies only a little, that is, the reference voltage circuit with low temperature drift in the above embodiment achieves the effects that the correlation between the output reference voltage and temperature is extremely low, and that in a certain operating environment, the circuit has strong anti-interference ability and can satisfy the application requirements for high precision.

As for the reference voltage circuit with low temperature drift in the above embodiment, the first voltage unit and second voltage unit both having the positive temperature coefficients or the negative temperature coefficients are directly used to calculate and obtain the value of K satisfying $K*(\partial V_1/\partial T)=(\partial V_2/\partial T)$, and then design a K times' amplification unit based on the value of K obtained through calculation; and the K times' amplification unit is connected into the circuit, thereby making the output reference voltage have extremely low correlation with the temperature, or independent of the temperature, that is, achieving the effects that, under different temperatures, that the output reference voltages do not diverge greatly, which can satisfy the application requirements for high precision. What's more, the circuit has simple structure, and few device types are required, thereby greatly reducing the difficulty and the risks in design. The reference voltage circuit has very high practicability and versatility in the field of the integrated circuit.

The technical features of the above-described embodiments may be arbitrarily combined. For the sake of brevity of description, not all possible combinations of the various technical features in the above embodiments are described. However, as long as there is no contradiction between the combinations of these technical features, all should be considered within the scope of the disclosure.

The above-mentioned embodiments are merely illustrative of several embodiments of the present application, and the description thereof is more specific and detailed, but not intended to limit the scope of the disclosure. It should be noted that various variations and modifications may be made by those skilled in the art without departing from the conception of the present disclosure, and these variations and modifications are all within the scope of the disclosure. Therefore, the scope of the disclosure should be subject to the appended claims.

What is claimed is:

1. A reference voltage circuit with low temperature drift, comprising a first voltage unit, a second voltage unit and a K times' amplification unit; wherein:

the first voltage unit is configured to generate a first voltage; a first end of the first voltage unit is grounded;

the K times' amplification unit is configured to amplify the first voltage by K times; a first end of the K times' amplification unit is connected to a second end of the first voltage unit; a second end of the K times' amplification unit is connected to a third end of the first voltage unit and connected to a current source circuit; K is a constant greater than zero;

the second voltage unit is configured to generate a second voltage; a first end of the second voltage unit is connected to the third end of the first voltage unit and connected to the current source circuit; and a second end of the second voltage unit serves as an output end of a reference voltage.

2. The reference voltage circuit with low temperature drift according to claim 1, wherein, the first voltage unit comprises a PMOSFET (P-channel Metal-Oxide Semiconductor Field-Effect Transistor) MP and a MOSFET (Metal-Oxide Semiconductor Field-Effect Transistor) M1; the second voltage unit comprises an NMOSFET (N-channel Metal-Oxide Semiconductor Field-Effect Transistor) MN and a MOSFET M2; the K times' amplification unit comprises a resistor R1 and a resistor R2; wherein:

a gate of the PMOSFET MP is connected to a first end of the resistor R1 and a first end of the resistor R2; a source of the PMOSFET MP is connected to a second end of the resistor R1 and then connected to the current source circuit; a drain of the PMOSFET MP is connected to a gate and a drain of the MOSFET M1; a source of the MOSFET M1 is grounded; a second end of the resistor R2 is grounded;

a gate and a drain of the NMOSFET MN are connected to the current source circuit; a source of the NMOSFET MN serves as the output end of the reference voltage and is connected to a drain of the MOSFET M2; a gate of the MOSFET M2 is connected to a gate and a drain of the MOSFET M1; and a source of the MOSFET M2 is grounded.

3. The reference voltage circuit with low temperature drift according to claim 1, wherein, the first voltage unit comprises a PNP transistor QP and a transistor Q1; the second voltage unit comprises an NPN transistor QN and a transistor Q2; the K times' amplification unit comprises a resistor R1 and a resistor R2, wherein:

a base of the PNP transistor QP is connected to a first end of the resistor R1 and a first end of the resistor R2; an emitter of the PNP transistor QP is connected to a second end of the resistor R1 and connected to the current source circuit; a collector of the PNP transistor QP is connected to a base and a collector of the transistor Q1, an emitter of the transistor Q1 is grounded; a second end of the resistor R2 is grounded;

a base and a collector of the NPN transistor QN are connected to the current source circuit; an emitter of the NPN transistor QN serves as the output end of the reference voltage and is connected to a collector of the transistor Q2; a base of the transistor Q2 is connected to the base and the collector of the transistor Q1; and an emitter of the transistor Q2 is grounded.

4. The reference voltage circuit with low temperature drift according to claim 1, wherein the current source circuit comprises a current mirror circuit.

5. The reference voltage circuit with low temperature drift according to claim 4, wherein, the current mirror circuit comprises a PMOSFET MP1, a PMOSFET MP2, a PMOSFET MP3, an NMOSFET MN1, an NMOSFET MN2, and a resistor Rs, wherein:

a source of the PMOSFET MP1, a source of the PMOSFET MP2 and a source of the PMOSFET MP3 are connected to the same power supply; a gate of the PMOSFET MP2 and a gate of the PMOSFET MP3 are connected to a gate of the PMOSFET MP1; and a gate of the PMOSFET MP3 is connected to a drain of the PMOSFET MP2;

a drain of the PMOSFET MP1 is connected to a drain and a gate of the NMOSFET MN1; and a source of the NMOSFET MN1 is grounded;

the drain of the PMOSFET MP2 is connected to a drain of the NMOSFET MN2; a gate of the NMOSFET MN2 is connected to a gate of the NMOSFET MN1; and a source of the NMOSFET MN2 is connected to the resistor Rs and grounded; and a drain of the PMOSFET MP3 is connected to the first end of the second voltage unit.

6. The reference voltage circuit with low temperature drift according to claim 2, wherein, the current source circuit comprises a current mirror circuit.

7. The reference voltage circuit with low temperature drift according to claim 6, wherein, the current mirror circuit comprises a PMOSFET MP1, a PMOSFET MP2, a PMOSFET MP3, an NMOSFET MN1, an NMOSFET MN2, and a resistor Rs, wherein:

a source of the PMOSFET MP1, a source of the PMOSFET MP2 and a source of the PMOSFET MP3 are connected to the same power supply; a gate of the PMOSFET MP2 and a gate of the PMOSFET MP3 are connected to a gate of the PMOSFET MP1; and a gate of the PMOSFET MP3 is connected to a drain of the PMOSFET MP2;

a drain of the PMOSFET MP1 is connected to a drain and a gate of the NMOSFET MN1; and a source of the NMOSFET MN1 is grounded;

the drain of the PMOSFET MP2 is connected to a drain of the NMOSFET MN2; a gate of the NMOSFET MN2 is connected to a gate of the NMOSFET MN1; and a source of the NMOSFET MN2 is connected to the resistor Rs and grounded; and a drain of the PMOSFET MP3 is connected to the first end of the second voltage unit.

8. The reference voltage circuit with low temperature drift according to claim 3, wherein, the current source circuit comprises a current mirror circuit.

9. The reference voltage circuit with low temperature drift according to claim 8, wherein, the current mirror circuit comprises a PMOSFET MP1, a PMOSFET MP2, a PMOSFET MP3, an NMOSFET MN1, an NMOSFET MN2, and a resistor Rs, wherein:

a source of the PMOSFET MP1, a source of the PMOSFET MP2 and a source of the PMOSFET MP3 are connected to the same power supply; a gate of the PMOSFET MP2 and a gate of the PMOSFET MP3 are connected to a gate of the PMOSFET MP1; and a gate of the PMOSFET MP3 is connected to a drain of the PMOSFET MP2;

a drain of the PMOSFET MP1 is connected to a drain and a gate of the NMOSFET MN1; and a source of the NMOSFET MN1 is grounded;

the drain of the PMOSFET MP2 is connected to a drain of the NMOSFET MN2; a gate of the NMOSFET MN2 is connected to a gate of the NMOSFET MN1; and a source of the NMOSFET MN2 is connected to the resistor Rs and grounded; and a drain of the PMOSFET MP3 is connected to the first end of the second voltage unit.

* * * * *